United States Patent [19]

Bodziak

[11] Patent Number: 4,524,932

[45] Date of Patent: Jun. 25, 1985

[54] RAILROAD CAR WHEEL DETECTOR USING HALL EFFECT ELEMENT

[75] Inventor: Thomas A. Bodziak, Neville Island, Pa.

[73] Assignee: American Standard Inc., Swissvale, Pa.

[21] Appl. No.: 454,519

[22] Filed: Dec. 30, 1982

[51] Int. Cl.[3] ..... B61L 1/16

[52] U.S. Cl. ..... 246/247; 246/249; 340/941; 377/9

[58] Field of Search ..... 246/247, 249, 122 R; 377/9; 338/32 H; 340/941; 324/251; 310/DIG. 3

[56] References Cited

U.S. PATENT DOCUMENTS

| | | | |
|---|---|---|---|
| 2,464,807 | 3/1949 | Hansen, Jr. | 310/26 |
| 2,736,822 | 2/1956 | Dunlap, Jr. | 307/309 X |
| 2,892,078 | 6/1959 | Orthuber | 246/249 |
| 2,973,430 | 2/1961 | Pelino | 246/249 |
| 3,086,109 | 4/1963 | Kaehms | 246/249 |
| 3,121,788 | 2/1964 | Hilbinger | 307/309 |
| 3,144,227 | 8/1964 | Suerkemper | 246/249 |
| 3,199,630 | 8/1965 | Engel et al. | 246/249 X |
| 3,297,866 | 1/1967 | Lippmann et al. | 246/249 X |
| 3,431,435 | 3/1969 | Bizet | 307/247 |
| 3,680,026 | 7/1972 | Masuda et al. | 338/32 H |
| 4,086,533 | 4/1978 | Ricouard et al. | 310/DIG. 3 X |
| 4,107,591 | 8/1978 | Herr et al. | 318/663 |
| 4,134,030 | 1/1979 | Pace | 307/309 |
| 4,451,018 | 5/1984 | Smith et al. | 246/249 X |

FOREIGN PATENT DOCUMENTS

| | | | |
|---|---|---|---|
| 1185645 | 1/1965 | Fed. Rep. of Germany | 246/249 |
| 853329 | 2/1960 | United Kingdom | 310/DIG. 3 |

*Primary Examiner*—Randolph Reese
*Attorney, Agent, or Firm*—J. B. Sotak

[57] ABSTRACT

A Hall effect element, incorporated into an integrated circuit unit with temperature compensation, voltage regulation, and amplification, is mounted on top of a permanent magnet made of ceramic material with the critical Hall axis aligned with the magnet pole axis. To avoid saturating the Hall cell, it is positioned within a pole-to-pole hole in the magnet, which creates a flux null space. The permanent magnet and Hall cell assembly is mounted on the rail a predetermined distance below the top so that the flange of passing wheels occupies the air gap between the magnet and the rail through which the major portion of the magnet flux flows. Reduction of the air gap increases the level of the magnet flux and thus the level of voltage output of the Hall cell. The output of the Hall cell is applied to a Schmitt trigger whose switching level is set by a threshold voltage unit. Increased Hall output voltage actuates the trigger circuit which applies the signal to a switching transistor whose output in turn is applied to a pulse detector which registers the wheel detection. The magnet, Hall circuit element, and processing network are encapsulated within an epoxy material which is fitted for direct mounting to the base of the track rail on the gauge side.

7 Claims, 6 Drawing Figures

RAILROAD CAR WHEEL DETECTOR USING HALL EFFECT ELEMENT

FIELD OF THE INVENTION

My invention relates to detector apparatus for railroad car wheels. More particularly, the invention pertains to such wheel detectors in which a Hall effect element detects the passing of each railroad car wheel along the track by the change in the flux level from a permanent magnet.

BACKGROUND OF THE INVENTION

Wheel detectors are among the most common type of apparatus in use to detect a particular part of a railroad car, that is, a wheel, at a known fixed point along the right-of-way, in contrast to area detection or detection of the presence of the entire car by various forms of proximity detectors. Wheel detectors may be used, for example, for activation and/or timing of such wayside apparatus as weigh rails, hot box detectors, and highway grade crossing signals, and also in classification yards for car following and switch protection functions. A commonly used type of wheel detector is the electromagnetic type. These generally use two wire coils, i.e., a transmitter and a receiver, placed on opposite sides of the rail. The specific operation differs but usually the coil location and the alignment with the other coil and with the rail are critical. Such units require a wayside apparatus case away from the rails to house the power supply, processing apparatus, and other items. Such a separate case also protects the apparatus from the weather, vandalism, and wayside maintenance equipment, reduces the effects of rail current and voltage surges induced, for example, by lightning, and eliminates the effect of rail vibrations. However, advantages in installation and maintenance of the wheel detector apparatus and increased economy in cost and operation can be obtained by eliminating the wayside case and still avoiding the extraneous detection signals resulting from induced currents and voltages. A wheel detector unit and associated apparatus mounted on the rail as a single module, preferably encased in epoxy, increases the advantages. In other words, a simple transducer unit entirely mounted on the rail to sense each wheel, thus eliminating the requirement for coils and power supplies and the criticality of the alignment, would be an effective unit. A well known Hall effect element mounted to respond to the change in a magnetic flux field due to the presence of the wheel will serve these goals.

Accordingly, an object of my invention is an improved detector for railroad car wheels using a Hall effect element to detect the passage of each wheel along the track rail.

Another object of the invention is an apparatus arrangement including a permanent magnet and a Hall effect element for detecting passage of railroad car wheels at a specific location along the track rail.

A further object of my invention is wheel detector apparatus for railroads including a ceramic type permanent magnet and a Hall effect element, positioned within a pole-to-pole opening in the permanent magnet, to respond to change in the flux density caused by the passage of a car wheel.

Yet another object of the invention is a wheel detector for railroad car wheels mounted on the gauge side of the track rail and consisting of a Hall effect element, mounted above a pole-to-pole opening in a permanent magnet, which responds to the change in the magnet flux level upon the passage of a wheel flange to generate a wheel detection signal.

Other objects, features, and advantages of the invention will become apparent from the following specification and appended claims when taken in connection with the accompanying drawings.

SUMMARY OF THE INVENTION

The rationale behind using the Hall effect device as the primary sensor in the wheel detector is based on the concept that a ferromagnetic wheel flange will change a static magnetic field in a repeatable fashion due to its particular shape, orientation, and location with respect to the rail. The Hall effect device will then translate the change in magnetic flux level into a voltage signal that can be used for wheel detection. In practicing the invention, a permanent magnet, made of an inexpensive ceramic material and shaped and fired into a desired form, is mounted along the rail on the gauge side, a predetermined distance below the top of the rail. As specifically shown, the magnet is shaped as a cube and the predetermined distance is such it will be cleared, with a small gap, by the flange of the passing wheel. Due to the large air gap when no wheel flange is present, a relatively high permanent magnet flux level is needed to provide sufficient change in the level, when the wheel passes, to be detected by a Hall effect element. The Hall effect element, incorporated in an integrated circuit package or chip with voltage regulators, temperature compensation, and an amplifier, is mounted on top of the permanent magnet centered in a pole-to-pole hole drilled through the permanent magnet to create a magnetic flux null, that is, a space with relative absence of a magnetic flux field. This is necessary to avoid saturating the Hall element with the high flux density necessary to bridge the air gap to the rail.

When a car wheel passes along the rail, its flange enters into the usual air gap, reducing its length and thus causing an increase in the flux level which flows, under this condition, in a path from the top of the permanent magnet through the flange and the rail, returning from the rail to the bottom of the magnet. The output of the Hall effect element is monitored by a circuit network consisting of a buffered threshold voltage which determines the switching level, a Schmitt trigger with hysteresis, and a transistor switch. The threshold voltage is preset in accordance with the particular Hall cell used so that the unit is precalibrated. The final output signal from the transistor is then processed as desired to produce a wheel detection signal. In the specific form shown, all of this Hall effect circuitry and the monitoring circuitry is embodied on circuit boards which may be encapsulated within a modular block for mounting directly at the rail so that a simple transmission channel from this unit to external apparatus is possible.

BRIEF DESCRIPTION OF THE DRAWINGS

Prior to defining the invention in the appended claims, I will describe a specific, preferred embodiment as illustrated in the accompanying drawings, in which:

In each of the drawing figures, similar reference characters designate similar or the same parts of the apparatus.

DESCRIPTION OF THE ILLUSTRATED EMBODIMENT

Figure 2A:
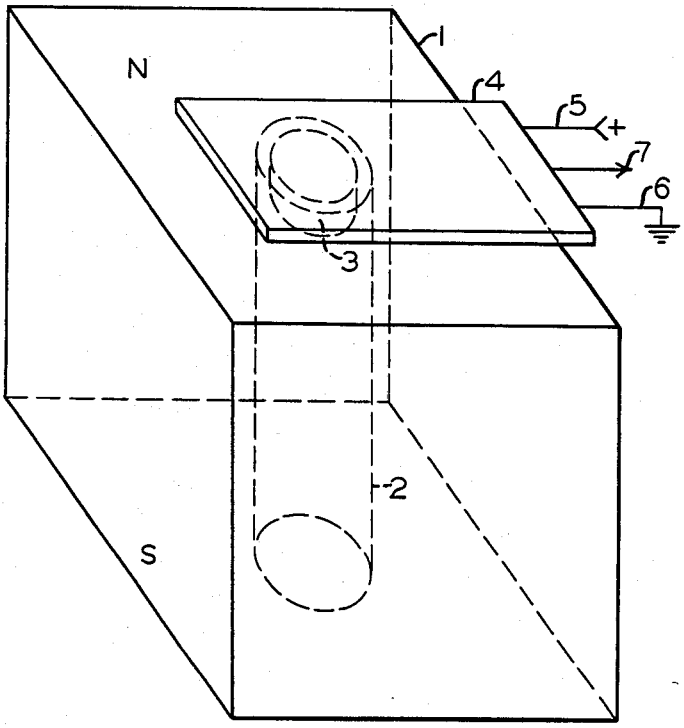
FIG. 2A is a perspective view of a permanent magnet block with the Hall cell integrated circuit board mounted on top and before encapsulation.

Referring initially to FIG. 2A, a perspective view of a permanent magnet block 1 is provided with pole positions as indicated by the references N and S, respectively. This magnet is made of inexpensive ceramic magnetic material which is readily available and is easily shaped and fired into a desired form, cubical as specifically shown here but it may also be a rectangular block. Such ceramic magnets have a negative temperature coefficient which is used to balance or counter any positive temperature coefficient present in the Hall effect element used. The magnet shape was chosen to have a large surface area to account for variations in the position of the wheel flange, both vertically and laterally, as it passes the detector location. The magnet is operated open circuit with no soft pole pieces, to assure a widely dispersed field or flux pattern. This ceramic magnetic material employed also exhibits high coercivity, eliminating the weakening of the magnetic field due to stray fields. Additionally, age and vibration have no particular effect on magnet strength.

A relatively large change in the field strength with the wheel flange directly overhead is required to assure reliable detection of the wheel, e.g., in one spcific arrangement, on the order of 100 gauss. Due to the large air gap, a change of this order requires approximately 2,000 gauss at the surface of the magnet. Such strong fields will saturate conventional Hall effect cells, which have only a limited range of magnetic field strength before such saturation. To avoid saturation, therefore, a small hole is drilled or formed from pole-to-pole in the permanent magnet block and the Hall effect cell is positioned over the hole, with its critical Hall axis parallel to the pole-to-pole axis of the magnet. This hole creates a magnetic null space within the hole and extending along the hole axis in each direction beyond the block. Thus, the Hall cell is affected by only a very small portion of the magnetic field and yet will respond to the change when a wheel passes. Creating the null space also has several other advantages. It allows a degree of immunity to variations in magnetic strength from piece to piece during the manufacturing process. Secondly, an edge effect or singularity exists around the hole which increases the change in signal level between the two states, that is, wheel present and wheel absent.

Figure 2B:
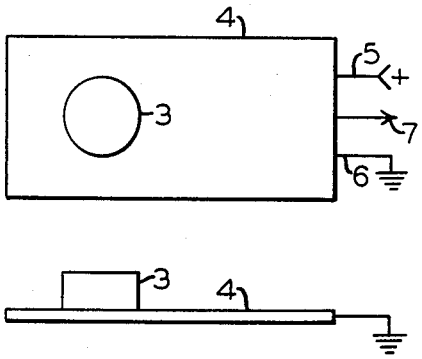
FIG. 2B shows plan and elevation views of the integrated circuit board including a Hall effect element.

The Hall effect element or cell 3 used is incorporated on a circuit board produced as an integrated circuit piece or board 4 which includes a voltage regulator, an amplifier, and laser-trimmed thick film resistors to provide temperature compensation. This results in units with high sensitivity, good stability, high noise immunity, and low per-unit cost. The integrated circuit board, e.g., a so-called circuit "chip", is illustrated in FIG. 2B by plan and side elevation views. Only three connections or leads are required, a positive supply lead 5 from a grounded direct current source, a ground connection lead 6, and the voltage signal output lead 7 for the detection signal. The Hall cell chip is positioned or mounted upside down (relative to FIG. 2B) on top of the permanent magnet block 1, as shown in FIG. 2A, with board 4 bonded to the surface of the magnet block. The actual Hall element 3 is centered within hole 2, with the sensitive "Hall axis" aligned in the vertical plane with the magnet pole axis. Normally, the assembly will then be encapsulated in some type of epoxy material for protection against the weather and other damage.

Figure 1A:
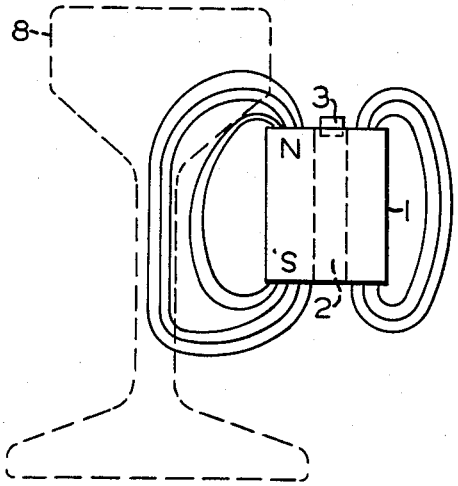
FIG. 1A is an end view showing a wheel detector assembly embodying the invention mounted adjacent the railroad track rail with a schematic representation of the flux pattern when no wheel is present.
Figure 1B:
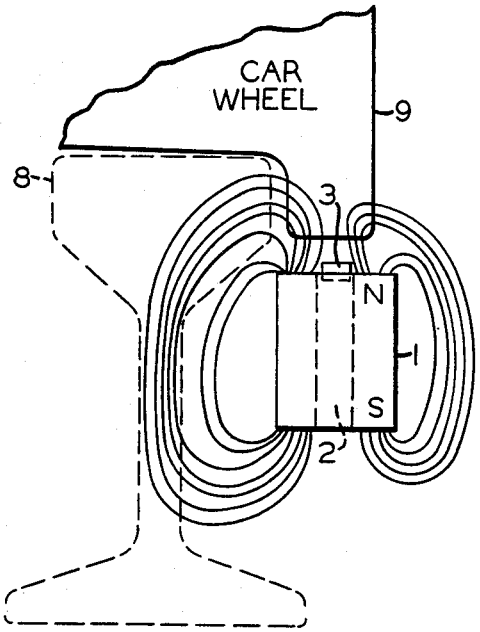
FIG. 1B is a similar view of the mounted wheel detector but illustrating the flux pattern when a car wheel is present at the detector location.

A schematic illustration of the positioning of the permanent magnet block and Hall cell assembly relative to a track rail but without encapsulation is provided in FIGS. 1A and 1B. FIG. 1A is an end-on view of the rail 8 (shown dotted to distinguish from flux lines) with permanent magnet block 1 positioned on the gauge side, i.e., the inner side between the two rails, a predetermined distance below the top of the rail. The permanent magnet block is positioned with the hole 2 vertical and the Hall cell assembly 3 at the top, the same as in FIG. 2A. In other words, the magnet pole axis is in the vertical plane, as designated by the pole references N and S. In one specific installation, the distance below the top of the rail is approximately $1\frac{1}{2}$ inches but the invention is not limited to this distance. The inner edge of the permanent magnet is shown aligned with the inside edge of the rail, again desirable but not a specific limitation.

The condition illustrated in FIG. 1A is without a car wheel present. The quasi-circular solid lines of this figure represent the magnet flux path or flow without the wheel. Due to the close proximity of the rail, the normal field pattern is distorted with the flux using the air gap and rail as the principal return path. The number of lines illustrated is representative of the relative field strength as compared with the condition shown in FIG. 1B, to be discussed. When a car wheel passes, the air gap is filled by the flange, decreasing the magnetic circuit reluctance which causes an increase in the flux density and a consequent increase in the voltage output from the Hall effect cell. FIG. 1B illustrates this condition, with the wheel shown only partially at 9 but with its flange occupying the space above the detector assembly of the permanent magnet 1 and cell 3. With the air gap partially filled, the flux pattern is shifted through the flange and rail and the reduced reluctance increases the flux density, shown relatively by more lines with respect to FIG. 1A. As mentioned, this results in an increased voltage output from the Hall effect cell.

Figure 3:
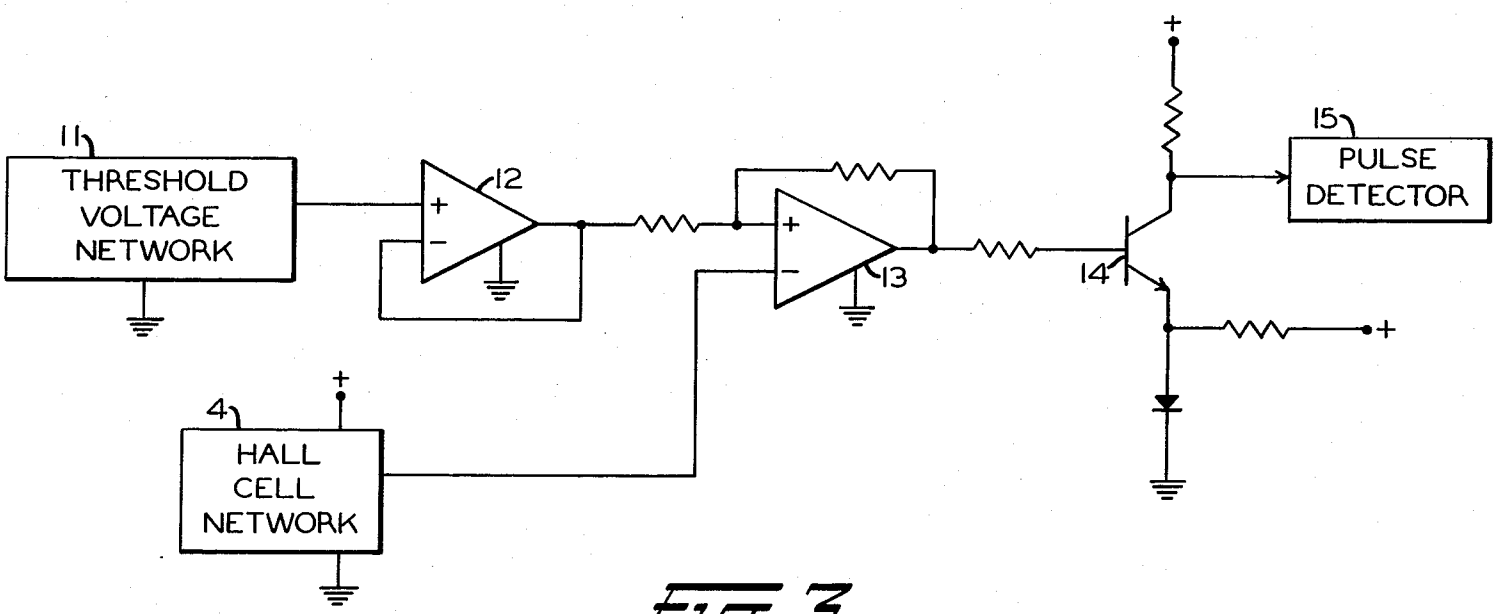
FIG. 3 is a circuit diagram, partly in block form, of a wheel detector output monitoring circuit network, which may be mounted on a printed circuit board.

The Hall effect cell output voltage is monitored by the circuitry shown in FIG. 3 which uses the change in output voltage from the Hall cell to register each wheel detection. The circuit network consists of a threshold voltage network 11, whose output is buffered by amplifier 12 into a Schmitt trigger arrangement 13 with hysteresis, and a transistor switch 14. The threshold voltage network determines the voltage level at which the input to Schmitt trigger 13 from the Hall cell network, illustrated by block 4, is switched. Block 4 represents the same integrated circuit element shown in FIG. 2B whose voltage signal increases when a wheel is present at the location of the detector unit. Hysteresis is incorporated into the Schmitt trigger element to eliminate multiple switching at the threshold level and to provide a single, well defined detector pulse for each wheel. The hysteresis requirement comes from the fact that fast moving trains vibrate both vertically and laterally and slow moving trains may cause oscillation due to long periods of output voltage right as the threshold level. The hysteresis is set by the ratio of the feedback resistors and in one specific design is approximately 0.1 volts which corresponds to about 2 inches of wheel travel. The sensitivity or threshold level is determined and preset at the time of manufacturing and results in a precalibrated unit. The output signal from the transistor switch 14 is applied to a pulse detector unit 15 which registers the presence and/or passage of the wheel. This pulse detector may also process the wheel signal applied to obtain additional results. For example, in one specific design, the detector produces an audio frequency signal for transmission to other locations for use in the total system, e.g., the car following arrangement in a classification yard.

Figure 4:
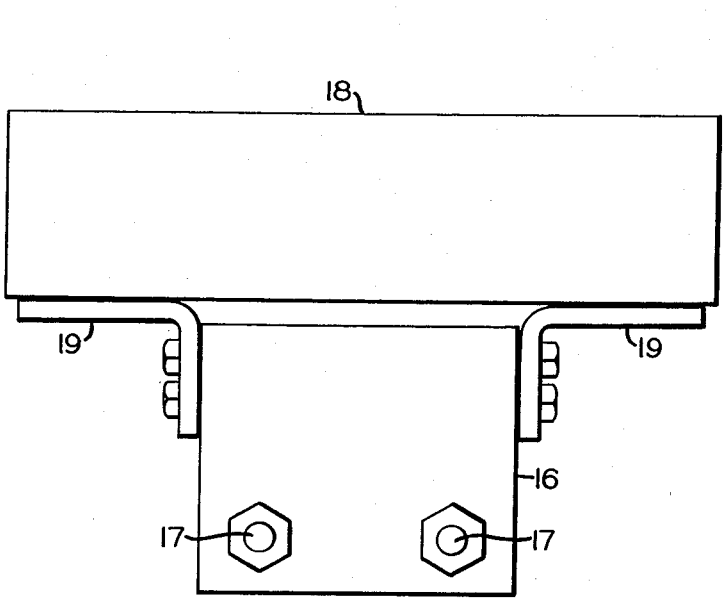
FIG. 4 provides end and side views of the preferred arrangement for mounting the encapsulated wheel detector module embodying the invention on a track rail.
Figure 4:
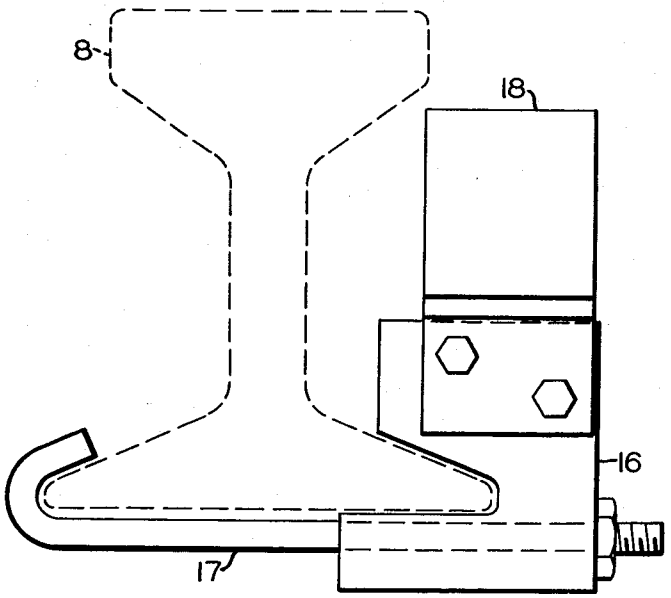

One practical method for mounting the apparatus on a rail is schematically illustrated in FIG. 4 which provides end and side elevation views in block form which are not intended to show all the details nor are the views to scale. The mounting includes a clamp piece 16 which fits over the base of rail 8 on the gauge side and is secured by one or more J-shaped bolts 17. The Hall cell element 4 secured to the permanent magnet block and the circuit portions illustrated in FIG. 3 mounted on a printed circuit board are encapsulated within an epoxy material, as illustrated by block 18, which is mounted to clamp piece 16 by brackets 19. Block 18 is shown in its side elevation view as extended to represent two such detector arrangements where registration of the direction of the wheel movement is also desired. Within block 18 may also be included such circuit boards as are necessary to process the raw pulse output from the network of FIG. 3 into audio frequency signals for further transmission, if so desired in the total system. The output leads and the securing of block 18 to the brackets 19 are not specifically illustrated in FIG. 4, as this would be a matter of design and desires in encapsulating the Hall effect apparatus. Other mounting arrangements, of course, are possible and may be used for specific installations. Also necessary adjustments may be provided in the various mountings in order to obtain the proper spacing and location of the apparatus in relationship to specific sizes of rails and passing wheels.

The railroad car wheel detector of the invention is thus an effective and accurate means for registering the passage of each car wheel. False detections are largely eliminated since the influence of external current and voltage surge signals is avoided. The unit is economic in material and does not require wayside cases since it is self-contained. Also, being entirely rail mounted, interference and/or damage during right-of-way maintenance is unlikely. The module mounting makes it practical to easily remove and replace the apparatus if rail work is required. The unit is precalibrated during manufacturing so that only field mounting adjustments are needed. The overall result is an effective, accurate, and efficient detector for railroad car wheels.

Although I have herein shown and described but one specific apparatus and arrangement for a railroad car wheel detector using the Hall effect element and embodying the invention, it is to be understood that various modifications and changes therein may be made within the scope of the appended claims without departing from the spirit and scope of the invention.

Having now described the invention, what I claim as new and desire to secure by Letters Patent, is:

1. Wheel detector apparatus for car wheels moving along a railroad track rail, comprising:

(a) a permanent magnet means with an internal hole extending parallel to the pole-to-pole axis for creating a magnetic flux null space along that axis within said hole and externally at both poles, (b) said magnet means positioned adjacent the gauge side of said rail a predetermined distance below the top of said rail with said pole-to-pole axis in vertical alignment with the flange of each passing car wheel, for generating a first and a second level of magnetic flux when a car wheel is absent and present, respectively, (c) a Hall effect means positioned at the upper end of said magnet means within said null space and with its critical axis parallel to said pole-to-pole axis, (d) said Hall effect means responsive to flux from said magnet means for generating an output voltage proportional to the existing flux level, and (e) a detector network coupled for responding only to said Hall effect means output voltage representing said second flux level to register the passage of a car wheel.

2. Wheel detector apparatus as defined in claim 1 in which, said permanent magnet is made of ceramic magnetic material formed in cubical shape with said pole-to-pole hole in the center of the cube.

3. Wheel detector apparatus as defined in claim 2 in which said Hall effect means comprises:

(a) a Hall effect cell responsive to a magnetic field parallel to its critical axis for generating an output voltage, and (b) a voltage regulating element, (c) temperature compensation resistors, and (d) an amplifier means, all coupled to said Hall effect cell for producing an output voltage signal directly proportional to the level of magnet flux influencing said Hall effect cell, and in which, (e) said Hall effect cell, voltage regulating element, compensation resistors, and amplifier means are assembled on a circuit board and encapsulated into an integrated circuit chip with input and output leads, and (f) said integrated circuit chip is bonded to the upper surface of said magnet cube, with said Hall effect cell within said hole and null space, and is coupled to said detector network by said output lead.

4. Wheel detector apparatus as defined in claim 3 in which said detector network includes, (a) a threshold voltage means operable for generating a predetermined threshold voltage signal equal to the Hall effect cell output voltage when said first flux level exists, (b) a Schmitt trigger element coupled for receiving said threshold voltage signal and the output signal from said Hall effect means and responsive thereto for producing an output signal only when said Hall effect means voltage signal is greater than said threshold voltage signal, (c) a switching transistor supplied with operating voltage and coupled to said Schmitt trigger element for producing an output pulse when a Schmitt trigger element output signal is received, and (d) pulse detector means coupled to said transistor switch and responsive to said output pulse to register passage of a car wheel along said rail.

5. Wheel detector apparatus as defined in claim 4 in which:

(a) said detector network apparatus is assembled on a circuit board, and (b) said permanent magnet and Hall effect cell circuit chip assembly and said detector network circuit board are encapsulated in a module mounted on the gauge side of said rail.

6. Wheel detector apparatus for registering car wheels moving past a fixed location along a railroad track rail, comprising:

(a) a permanent magnet with a hole parallel to the pole-to-pole axis for creating a null space in the flux pattern within said hole and externally surrounding the extended hole axis, (b) said magnet positioned adjacent the gauge side of said rail with its pole axis vertical for establishing a first flux path through an air gap and said rail, when no wheel is present at said location, through which a first flux level flows, (c) said magnet establishing a second flux path, when a wheel is present at that location, through the wheel flange and said rail, having a lower reluctance through which a second higher level flux flows, (d) a Hall effect means positioned at the top of said magnet within said hole and null space, and with its critical axis parallel to said pole-to-pole axis, and responsive to magnet flux for generating a first and a second output voltage in response to said first and said second flux levels, respectively, and (e) a monitoring network having a preset threshold voltage level equal to said first output voltage of said Hall effect means and coupled thereto for producing an output to register a car wheel only when said Hall effect means output voltage is at said second level.

7. Wheel detector apparatus as defined in claim 6 in which said monitoring network includes:

(a) threshold voltage means operable for supplying a predetermined threshold output voltage equal to said first voltage output of said Hall effect means, (b) a Schmitt trigger element coupled to said threshold voltage means and said Hall effect means and jointly responsive to output signals therefrom for producing an output pulse only when a second output voltage is received from said Hall effect means, (c) a transistor switch coupled to said trigger element and an operating power supply for producing a car wheel output signal when an output pulse is received from said trigger element, and (d) a register means coupled to said transistor switch and responsive to output signals for registering the the passage of each car wheel along said rail.

* * * * *